US005976030A

United States Patent [19]

Hsieh

[11] Patent Number: 5,976,030

[45] Date of Patent: Nov. 2, 1999

[54] ADJUSTABLE GOLF CLUB HANDLE MOUNTING ARRANGEMENT

[76] Inventor: Chih-Ching Hsieh, No. 64, Lane 107, Liang Tsun Rd., Fong Yuan City, Taichung Hsien, Taiwan

[21] Appl. No.: 09/104,211

[22] Filed: Jun. 25, 1998

[51] Int. Cl.[6] ..... A63B 53/02; A63B 53/16

[52] U.S. Cl. ..... 473/296; 473/306; 473/299

[58] Field of Search ..... 473/296, 305, 473/306, 316, 299, 300, 288; 403/359, 309, 313, 298; 81/177.2; 15/144.3, 144.4, 145

[56] References Cited

U.S. PATENT DOCUMENTS

| | | | |
|---|---|---|---|
| 1,613,360 | 1/1927 | Rigby | 473/296 |
| 1,665,811 | 4/1928 | Hadden | 473/306 |
| 1,932,902 | 10/1933 | McDowell | 473/306 |
| 2,129,068 | 9/1938 | Reach | 473/306 |
| 3,170,691 | 2/1965 | Pritchard | 473/306 |
| 3,759,517 | 9/1973 | Mills | 473/306 |
| 5,390,921 | 2/1995 | De Ruyter | 473/299 |
| 5,452,891 | 9/1995 | Thomas | 473/300 |
| 5,478,074 | 12/1995 | Storper | 473/299 |
| 5,649,870 | 7/1997 | Harrison | 473/296 |

*Primary Examiner*—Sebastiano Passaniti
*Attorney, Agent, or Firm*—Varndell & Varndell, PLLC

[57] ABSTRACT

An adjustable golf club handle mounting arrangement includes a threaded adjustment rod member having a split coupling tube at one end, a shaft having a bottom end fastened to a club head by a screw joint and a top end inserted into the split coupling tube of the adjustment rod member, an internally threaded grip threaded onto the threaded adjustment rod member, and a tapered holding down socket sleeved onto the split coupling tube of the adjustment rod member to hold down the split coupling tube of adjustment rod member on the top end of the shaft, causing the split coupling tube of the adjustment rod member and the top end of the shaft together to be firmly secured together.

2 Claims, 6 Drawing Sheets

ADJUSTABLE GOLF CLUB HANDLE MOUNTING ARRANGEMENT

BACKGROUND AND SUMMARY OF THE INVENTION

The present invention relates to golf club, and more specifically to an adjustable golf club handle mounting arrangement which permits the user to conveniently adjust the length of the golf club handle.

A regular golf club handle, as shown in FIG. 1, is generally comprised of a shaft having a bottom end fixedly fastened to the neck of a club head and a top end, and a grip fixedly fastened to the top end of the shaft and made to be held by the hand. Because the shaft is fixedly fastened to the club head and the grip is fixedly fastened to the shaft, the club head is not replaceable, and the length of the club handle is not adjustable.

It is one object of the present invention to provide an adjustable golf club handle mounting arrangement which permits the user to replace the club head conveniently. It is another object of the present invention to provide an adjustable golf club handle mounting arrangement which permits the user to adjust the length of the golf club handle. To achieve these and other objects of the Present invention, there is provided a golf club handle mounting arrangement which comprises a threaded adjustment rod member having a split coupling tube at one end, a shaft having a bottom end fastened to a club head by a screw joint and a top end inserted into the split coupling tube of the adjustment rod member, an internally threaded grip threaded onto the threaded adjustment rod member, and a tapered holding down socket sleeved onto the shaft and pushed upwards to hold down the split coupling tube of adjustment rod member, causing the split coupling tube of the adjustment rod member and the top end of the shaft together to be firmly secured together. Because the club head is fastened to the shaft by a screw joint, the user can replace the club head conveniently. Further, when the tapered holding down socket is pulled downwards from the split coupling tube, the adjustment rod member can be turned in the grip to adjust the length of the golf club handle.

DETAILED DESCRIPTION OF THE PREFERRED EMBODIMENT

Figure 1:
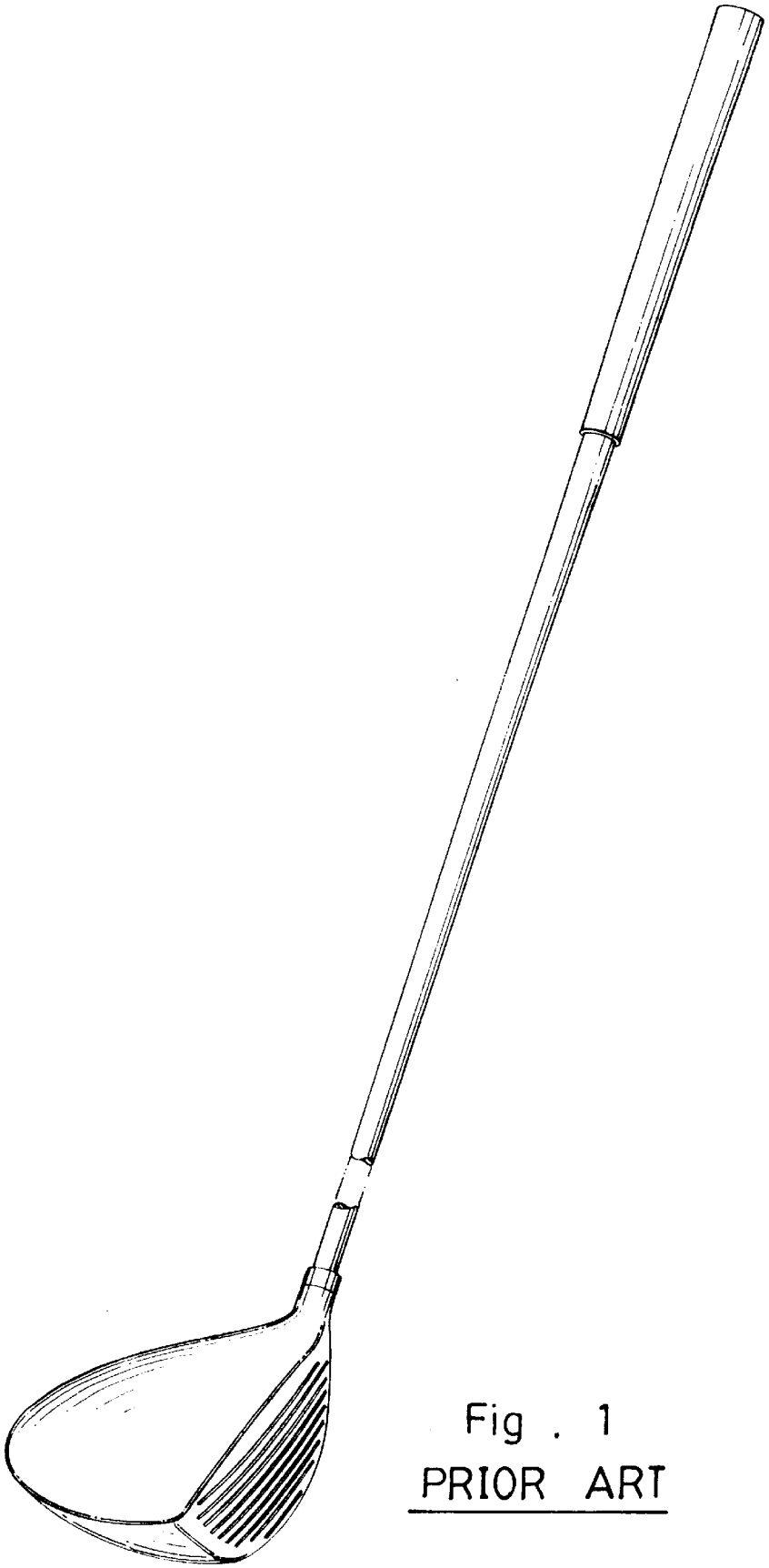
Fig . 1 PRIOR ART
FIG. 1 shows a golf club according to the prior art.
Figure 2:
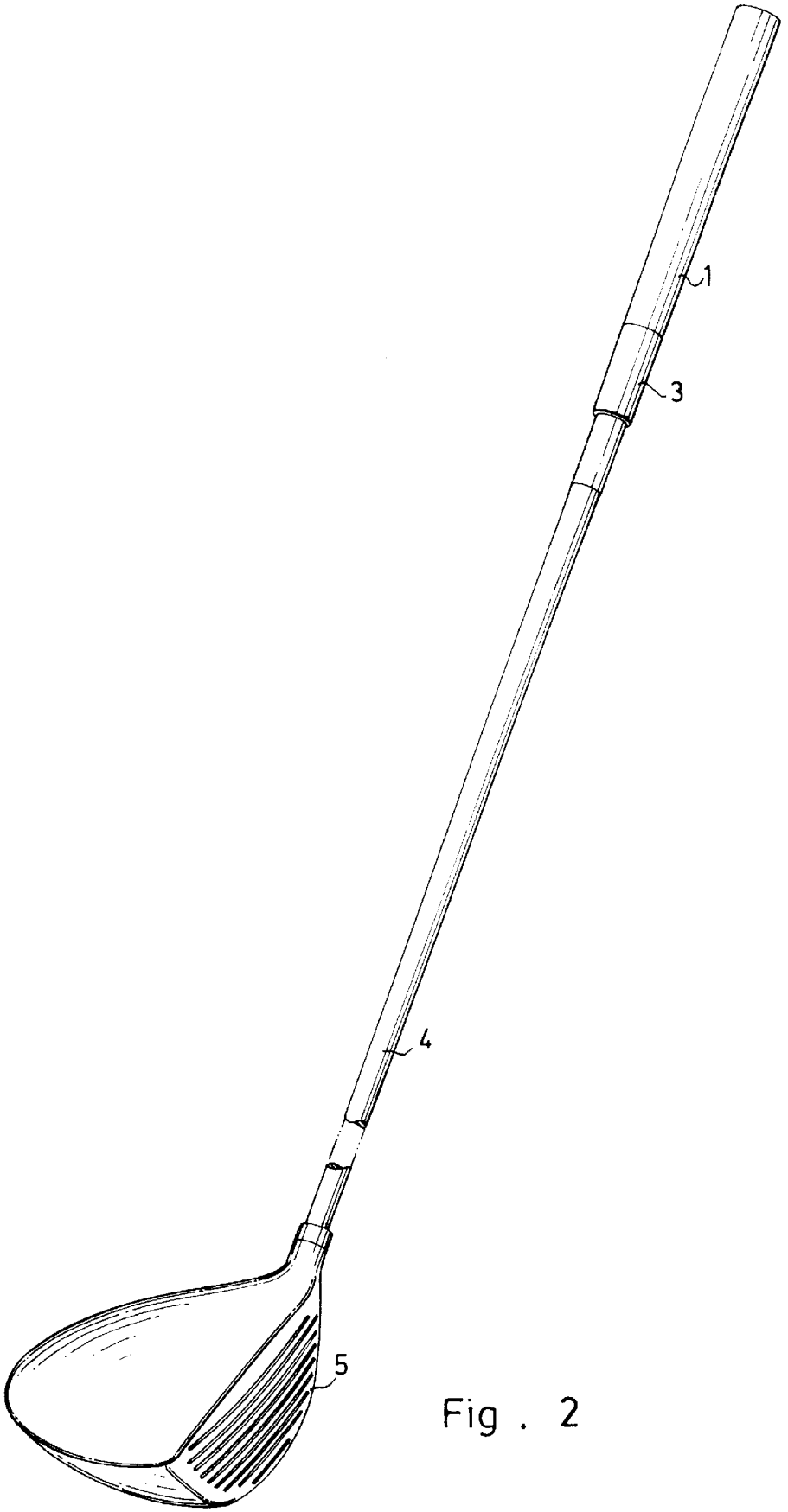
FIG. 2 shows a golf club constructed according to the present invention.
Figure 3:
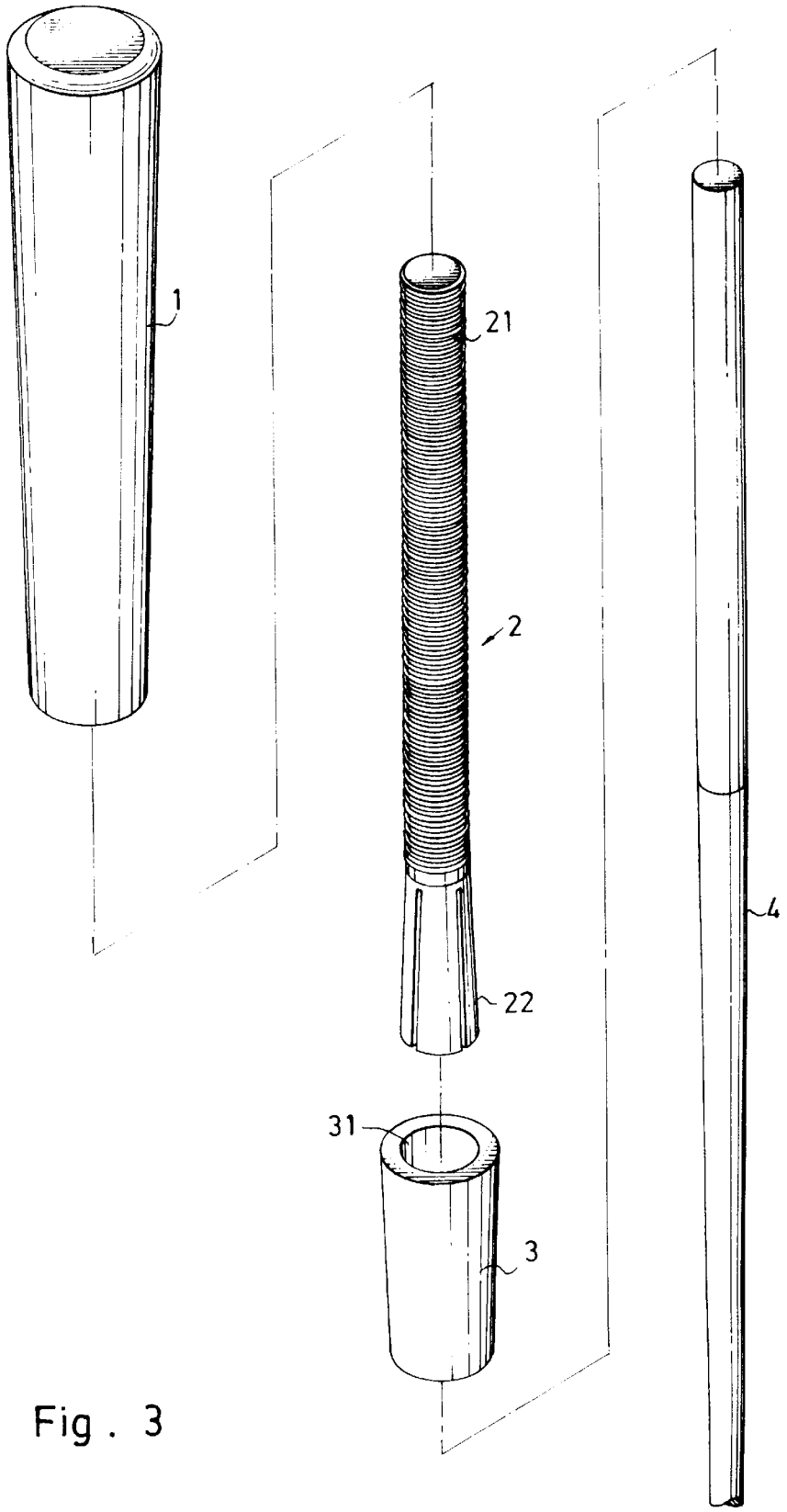
FIG. 3 is an exploded view of a golf club handle for a golf club according to the present invention.
Figure 4:
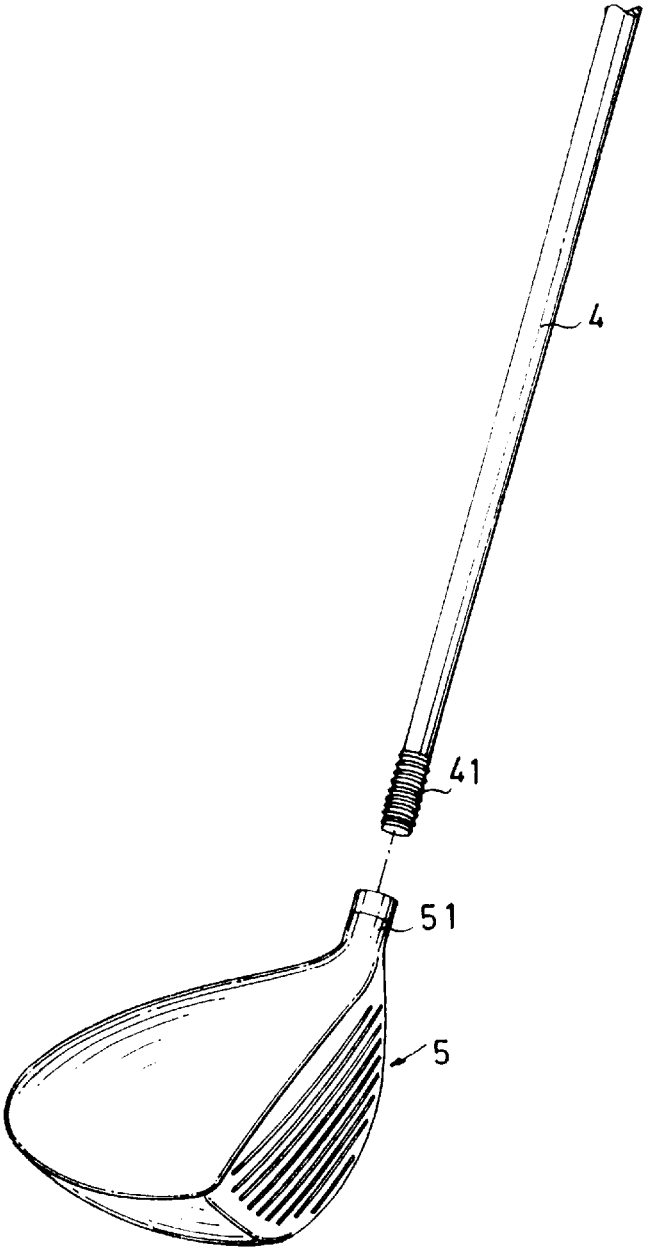
FIG. 4 is an exploded view of a part of FIG. 2, showing the shaft disconnected from the club head.
Figure 5:
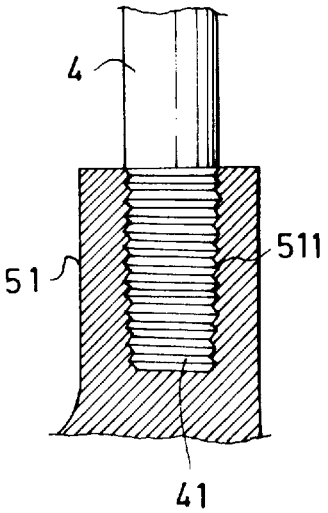
FIG. 5 is a sectional view showing the threaded bottom end of the shaft threaded into the screw hole on the neck of the club head according to the present invention.
Figure 6:
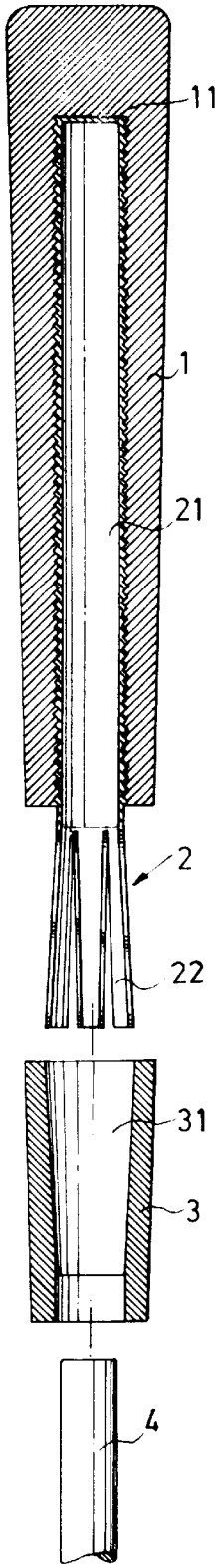
FIG. 6 is an exploded plain view of the present invention.
Figure 7:
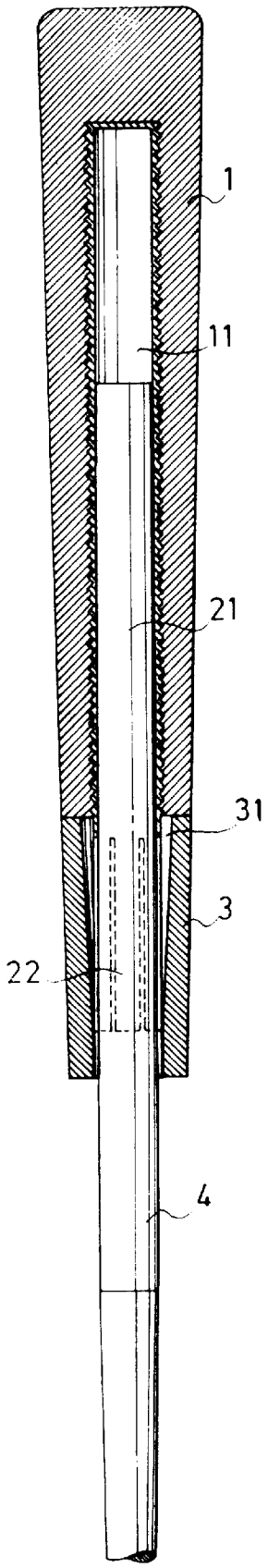
FIG. 7 is a sectional assembly view of the present invention.

Referring to FIGS. 2 and 3, an adjustable golf club handle mounting arrangement in accordance with the present invention is generally comprised of a grip 1, an adjustment rod member 2, a holding down socket 3, a shaft 4, and a club head 5.

Referring to Figures from 4 through 7 and FIGS. 2 and 3 again, the grip 1 is an elongated, tapered covering member having a bottom end opened, a top end closed, and a screw hole 11 extended from the opening of the bottom end toward the closed top end. The adjustment rod member 2 comprises an elongated, threaded rod body 21 threaded into the screw hole 11 on the grip 1, and a split coupling tube 22 longitudinally extended from one end of the threaded rod body 21 and coupled to one end namely the top end of the shaft 4. The holding down socket 3 is a tapered member defining a longitudinally extended, tapered through hole 31, which receives the split coupling tube 22 of the adjustment rod member 2 and the top end of the shaft 4 to hold the split coupling tube 22 and the top end of the shaft 4 firmly together. The shaft 4 has a threaded bottom end 41 threaded into a screw hole 511 at the neck 51 of the club head 5.

Referring to Figures from 4 through 7 again, during the assembly process, the threaded rod body 21 of the adjustment rod 2 is threaded into the screw hole 11 on the grip 1, then the threaded bottom end 41 of the shaft 4 is threaded into the screw hole 511 on the neck 51 of the club head 5, and then the top end of the shaft 4 is inserted through the holding down socket 3 into the split coupling tube 22 of the adjustment rod member 2, and then the holding down socket 3 is moved upwards and sleeved onto the split coupling tube 2 to compress the split coupling tube 2 radially inwardly against the periphery of the top end of the shaft 4, causing the top end of the shaft 4 and the split coupling tube 2 of the adjustment rod member 2 to be firmly secured together. When the holding down socket 3 is pulled downwards and disengaged from the split coupling tube 2 of the adjustment rod member 2, the adjustment rod member 2 can then be turned in the screw hole 11 to change the length of the club handle.

I claim:

1. An adjustable golf club handle mounting arrangement comprising:

a club head having a neck;

an adjustment rod member having a threaded rod body and a split coupling tube longitudinally extended from one end of said threaded rod body;

a shaft having a bottom end connected to the neck of said club head and a top end inserted into the split coupling tube of said adjustment rod member;

a grip having a longitudinally extended screw hole threaded onto the threaded rod body of said adjustment rod member; and a tapered holding down socket sleeved onto the split coupling tube of said adjustment rod to hold down the split coupling tube of said adjustment rod member on the top end of said shaft and to secure the split coupling tube of said adjustment rod member and the top end of said shaft together.

2. The adjustable golf club handle mounting arrangement of claim 1 wherein the neck of said club head has a screw hole, and the bottom end of said shaft has a threaded portion threaded into the screw hole on the neck of said club head.

* * * * *